United States Patent [19]

Spector

[11] Patent Number: 4,884,704

[45] Date of Patent: Dec. 5, 1989

[54] PERFUME CONTAINER

[76] Inventor: Donald Spector, 380 Mountain Rd., Union City, N.J. 07087

[21] Appl. No.: 316,017

[22] Filed: Feb. 27, 1989

[51] Int. Cl.[4] ..... B65D 33/28

[52] U.S. Cl. ..... 215/12.1

[58] Field of Search ..... 206/451; 383/72; 215/12.1, 12.2

[56] References Cited

U.S. PATENT DOCUMENTS

| | | | |
|---|---|---|---|
| 2,565,283 | 8/1951 | Throckmorton | 383/75 |
| 3,006,780 | 10/1961 | Shaffer | 206/457 X |

FOREIGN PATENT DOCUMENTS

| | | | |
|---|---|---|---|
| 402740 | 9/1924 | Fed. Rep. of Germany | 215/12.1 |
| 920729 | 4/1947 | France | 215/12.1 |
| 930235 | 1/1948 | France | 215/12.1 |
| 1422732 | 11/1965 | France | 215/12.1 |
| 2402592 | 5/1979 | France | 215/12.1 |
| 292280 | 3/1936 | Italy | 215/12.1 |

*Primary Examiner*—William Price
*Attorney, Agent, or Firm*—Michael Ebert

[57] ABSTRACT

A perfume container constituted by a plain glass bottle encased in a low-cost pouch of an ornamental fabric which transforms the appearance of the bottle to provide a container that appears to be custom-made and expensive, and in doing so imparts greater value to the perfume contents. The bottle has a predetermined geometric cross section, a flat bottom and an upper shoulder joined to a cap-receiving neck. The cross section of the pouch matches that of the bottle whereby the bottle is snugly received therein. The height of the pouch exceeds that of the bottle to define an upper section extending above the shoulder and having an open mouth whose lip is provided with a drawstring. When the drawstring is pulled and then tied to the neck of the bottle, the upper section of the pouch is caused to overlie the shoulder, the bottle then being fully encased, save for its neck.

8 Claims, 1 Drawing Sheet

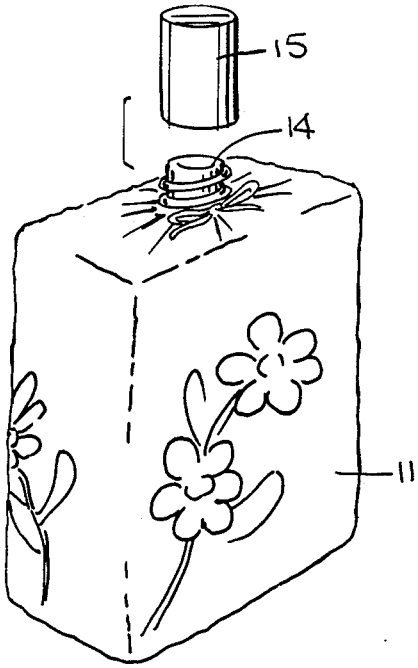
Fig. 1.
Fig. 2.
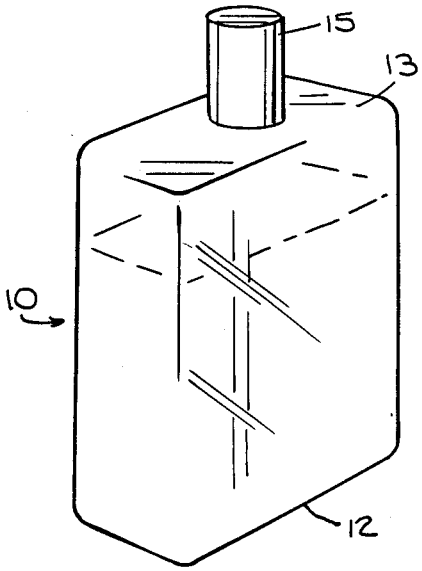
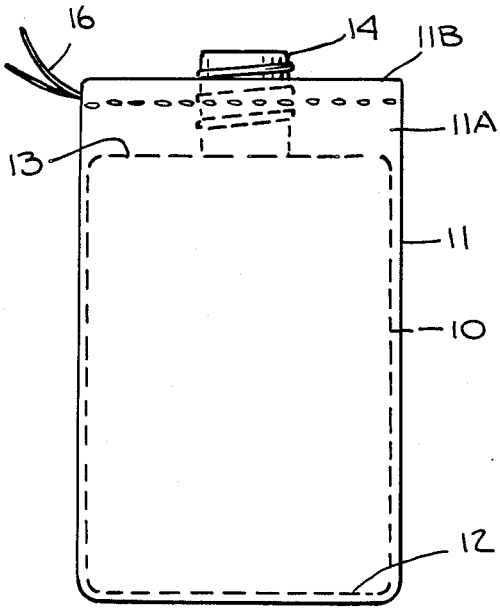
Fig. 3.
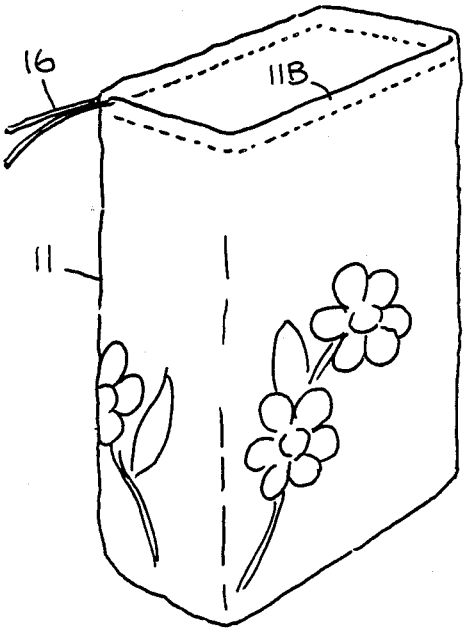
Fig. 4.
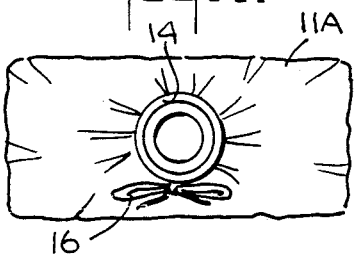

PERFUME CONTAINER

BACKGROUND OF INVENTION

1. Field of Invention:

This invention relates generally to perfume containers, and in particular to a container formed by a plain glass bottle encased in a low-cost ornamental fabric which transforms the appearance of the bottle and renders it highly attractive and costly looking, and in doing so, imparts greater value to the perfume contents.

2. State of Prior Art:

The burning of incense that accompanied religious rites in ancient China, Palestine and Egypt led gradually to the personal use of perfumes extracted from the essential oils of flowers and other plants. Today, most perfumes are blended of natural and synthetic scents and of fixatives which equalize vaporization of the scents and add pungency thereto.

Currently, the actual cost of producing a perfume is not high, yet the retail cost of a one-ounce bottle of perfume may run well over a hundred dollars, far beyond the production cost of its contents. There are several factors which account for this marked differential, and these will now be considered.

First, those who purchase perfume—and these purchasers are not limited to women, for men often buy perfume as gifts—assume that the more expensive the perfume, the finer its quality and the more appealing its scent. A woman charged with wearing a cheap perfume is understandably offended by this charge. To the degree she can afford to do, a woman will wear a recognizably expensive perfume, for women and many men are familiar with the scents of costly brand-name perfumes. Hence were exactly the same perfume sold in different bottles bearing different brand names, one at $10 and the other at $25, the $25 bottle is likely to enjoy greater sales.

Another reason why some perfumes are more expensive than others even though there is no substantial difference between the perfumes is that the more expensive perfume is likely to bear the name of a famous dress designer, a well known actress or other celebrated figure having high status in the world of fashion. Consumers tend to assume that a celebrity-sponsored perfume is superior to one lacking the cachet of a famous name.

Still another factor which comes into play in inducing consumers to purchase the higher priced perfume is that the manufacturer of this perfume has a greater mark up over production costs to work with than if the same perfume retailed at a lower cost. This mark up is in large part used to underwrite extensive advertising and promotion. While such promotion eats into the manufacturer's profit margin per bottle, he more than makes up for this by an increased volume of sales.

To give consumers the impression that a perfume is of the highest quality, and though expensive it should be purchased, packaging plays a vital role. Perfumes are often judged by the appearance of their bottles, which is why perfume manufacturers pay great attention to bottle design.

Here again, human psychology comes into play, for one tends in response to a plain bottle to assume that the perfume contained therein is cheap and to think more highly of perfume in a fancy bottle, depending, of course, on how fancy. If, for example, one perfume is contained in a highly attractive globular bottle of tinted glass and another in a multi-faceted bottle of crystal glass that looks like an oversized diamond, the consumer, if offered a choice and if she can afford to do so, will opt for the diamond on the assumption that the diamond is reserved for a perfume of the very finest quality.

Hence while the scent of a given perfume may be more to the personal taste of a consumer than that of another perfume, the consumer may be reluctant to purchase the perfume she really prefers because it is contained in a cheap looking bottle. The familiar maxim that a book should not be judged by its cover does not apply to perfumes, for these are often judged by their bottle.

Our purpose in this discussion is not to be critical of marketing practices in the perfume field. As one leader in this field once pointed out, we are dealing here not with reality but with illusions. It is vital, therefore, that when a woman chooses a perfume because she imagines it will enhance her allure, that this elixir not come in a plain, workaday bottle and thereby shatter this illusion.

Since the invention resides in a fabric-covered perfume bottle, it is to be noted that in the wine field some bottles are encased in monk's or other rough cloth, not to render the bottle more attractive but to protect it against breakage.

SUMMARY OF INVENTION

In view of the foregoing, the main object of this invention is to provide a container for a perfume which makes use of a plain bottle for this purpose whose appearance is transformed by an ornamental, low-cost fabric casing whereby the container appears to be expensive and thus imparts a similar impression to the perfume contents.

More specifically, an object of the invention is to provide a perfume container of the above type in which the fabric casing is constituted by a pouch having a drawstring, which pouch may readily be combined with a plain bottle.

Thus a significant advantage of the invention is that the container formed by the bottle and pouch is easily assembled, and the containers may be mass produced at low cost.

Also an object of the invention is to provide a container whose fabric casing has absorbent properties so as to retain a trace amount of the perfume, making it possible for a consumer to smell the perfume without having to open the bottle.

Still another advantage of the container, apart from the fact that it is more attractive than a plain glass bottle, is its tactile qualities; for if the fabric is, say, velvet or other soft fabric, it feels good in the hand and suggests luxury.

Briefly stated, these objects are attained in a perfume container constituted by a plain glass bottle encased in a low-cost pouch of an ornamental fabric which transforms the appearance of the bottle to provide a container that appears to be custom-made and expensive, and in doing so imparts greater value to the perfume contents. The bottle has a predetermined geometric cross section, a flat bottom and an upper shoulder joined to a cap-receiving neck. The cross section of the pouch matches that of the bottle whereby the bottle is snugly received therein. The height of the pouch exceeds that of the bottle to define an upper section extending above the shoulder and having an open mouth whose lip is provided with a drawstring. When the drawstring is pulled and then tied to the neck of the bottle, the upper section of the pouch is caused to overlie the shoulder, the bottle then being fully encased, save for its neck.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a perfume container in accordance with the invention;

FIG. 2 is an exploded view of the container;

FIG. 3 is a side view showing the bottle in the pouch before the drawstring is pulled; and FIG. 4 is a top view of the container after the drawstring is pulled.

DESCRIPTION OF INVENTION

Referring now to FIG. 1, there is shown a container for perfume formed by a plain glass bottle, generally designated by numeral 10, bottle 10 being encased in a fabric casing 11. Bottle 10, as shown separately in FIG. 2, has a rectangular cross section, a flat, rectangular bottom 12 and a flat upper shoulder 13 to which is joined a cylindrical neck 14 which is externally threaded to receive a cap 15.

Such bottles are stock items and are available at low cost. The bottle capacity depends on the amount of perfume for which it is intended, and the bottle may be in a ½ ounce size, a one ounce size or any other size conventionally used in marketing perfumes.

Casing 11, as shown separately in FIG. 3, is in pouch form and is woven or otherwise fabricated of fibers in a decorative pattern. The pouch has a rectangular cross section matching that of the bottle so that the bottle is snugly received in the pouch. In practice, it is preferable, before inserting the bottle in the pouch, to coat the surface of the bottle, save for the shoulder and neck, with a bonding agent so that when the bottle is in place, the casing is integrated therewith and the fabric is effectively the outer surface of the bottle and is not loose.

Apart from the fact that the fabric casing renders the container more attractive and acts to cushion and thereby protect the glass bottle, it also serves to transmute the bottle so that it not only has a extravagant look but also a luxurious feel or hand. Normally, the feel or hand of a perfume bottle is not taken into account. But it should be in the context of a luxury item; for just as a mink fur wrap looks expensive, it also has a luxurious feel, and the mink experience depends on both factors. Thus the fabric used may be woven of highly decorative in combination metallized yarns to impart glitter to the fabric with velvet or other soft, absorbent material.

It then becomes possible to apply trace amounts of perfume to the fabric which are retained therein. In this way, a purchaser, in order to sample the scent, need not be required to open the bottle for this purpose. Since a perfume container is normally boxed, there is little loss of scent before the box is opened.

As shown in FIGS. 2 and 3, fabric pouch 11 has a height somewhat greater than that of bottle 10, so that an upper section 11A extends above shoulder 13. The open mouth of section 11A has a lip formed by an internal channel 11B through which a drawstring 16 extends, the opposite ends of the drawstring existing from adjacent openings in the channel.

When bottle 10 is within the pouch and the drawstring ends are pulled to constrict the mouth, then, as shown in FIG. 4, the upper section llA of the pouch is caused to overlie shoulder 13 of the bottle, and the constricted mouth now encircles neck 14 of the bottle. The drawstring ends are then tied around neck 14 to maintain this condition.

As a consequence, the entire bottle, save for the neck, is fully encased by the fabric pouch which conforms thereto. When cap 15 is screwed onto neck 14, no glass is then visible, and the container appears to be of costly fabric construction. In practice, the cap, which is usually of plastic construction, may be provided with a metallized finish in a pattern matching the pattern of metallized fibers on the fabric.

The invention is not limited to a plain glass bottle having a rectangular cross section, for it is also applicable to bottles having a circular or other geometric cross section, in which case the fabric pouch must have a corresponding cross section.

While there has been shown and described a preferred embodiment of a perfume container in accordance with the invention, it will be appreciated that many changes and modifications may be made therein without, however, departing from the essential spirit thereof. Thus while the container has been described as being a container for perfume, it can also be used for other costly liquids such as liqueurs and brandies, particularly in small gift sizes, to be given away as premiums.

I claim:

1. A liquid container comprising:

(a) a plain glass bottle having a predetermined cross section, a flat bottom and an upper shoulder joined to a cap-receiving neck;

(b) a pouch formed of ornamental fabric material, said pouch having a cross section matching that of the bottle to snugly receive the bottle, and a height which exceeds that of the bottle to define an upper section which extends above the shoulder, the upper section having an open mouth whose lip is provided with a drawstring which when pulled and then tied to the neck, causes the upper section to overlie and fully cover the shoulder and surround the neck whereby the bottle is then fully encased and the pouch conforms to its surface, save for the neck, and the ornamental fabric transforms the appearance of the bottle to provide an expensive looking container, said pouch being bonded to the surface of the bottle; and (c) a removable cap received on the neck and seated on the upper section surrounding the neck whereby no shoulder glass is then visible.

2. A container as set forth in claim 1, wherein said cross section is rectangular and said shoulder is parallel to said flat bottom.

3. A container as set forth in claim 1, wherein said liquid is a perfume.

4. A container as set forth in claim 1, wherein said liquid is a liqueur.

5. A container as set forth in claim 1, wherein said neck is externally threaded to receive an internally threaded cap.

6. A container as set forth in claim 1, wherein the outer surface of the cap is ornamented to harmonize with that of the fabric.

7. A container as set forth in claim 1, wherein the fabric has absorbent constituents impregnated with a trace amount of the liquid.

8. A container as set forth in claim 1, wherein said is woven metallized yarns.

* * * * *

UNITED STATES PATENT OFFICE

CERTIFICATE OF CORRECTION

Patent No. 4,884,704 Dated December 5, 1989

Inventor(s) Donald Spector

It is certified that error appears in the above-identified patent and that said Letters Patent is hereby corrected as shown below:

Column 4, line 66, after "said" insert --fabric--.

Column 4, line 67, after "woven" insert --of--.

Signed and Sealed this

Thirtieth Day of April, 1991

*Attest:*

HARRY F. MANBECK, JR.

*Attesting Officer*

*Commissioner of Patents and Trademarks*